US011145476B2

(12) United States Patent
Stelter

(10) Patent No.: US 11,145,476 B2
(45) Date of Patent: Oct. 12, 2021

(54) ELECTRIC HIGH-VOLTAGE CIRCUIT BREAKER

(71) Applicant: GENERAL ELECTRIC TECHNOLOGY GMBH, Baden (CH)

(72) Inventor: Achim Stelter, Baden (DE)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 0 days.

(21) Appl. No.: 16/624,386

(22) PCT Filed: Jun. 11, 2018

(86) PCT No.: PCT/EP2018/065323
§ 371 (c)(1),
(2) Date: Dec. 19, 2019

(87) PCT Pub. No.: WO2018/234076
PCT Pub. Date: Dec. 27, 2018

(65) Prior Publication Data

US 2020/0219689 A1 Jul. 9, 2020

(30) Foreign Application Priority Data

Jun. 20, 2017 (EP) ..... 17176899

(51) Int. Cl.
*H01H 33/86* (2006.01)
*H01H 33/90* (2006.01)
*H01H 33/91* (2006.01)

(52) U.S. Cl.
CPC ..... *H01H 33/901* (2013.01); *H01H 33/86* (2013.01); *H01H 33/91* (2013.01); *H01H 2033/906* (2013.01); *H01H 2033/908* (2013.01)

(58) Field of Classification Search
CPC ..... H01H 33/901; H01H 33/86; H01H 33/91; H01H 2033/906; H01H 2033/908; H01H 33/70; H01H 33/88; H01H 2033/907
(Continued)

(56) References Cited

U.S. PATENT DOCUMENTS 5,561,280 A * 10/1996 Blatter ..... H01H 33/904 218/59
5,589,673 A * 12/1996 Lehmann ..... H01H 33/91 218/60
(Continued)

FOREIGN PATENT DOCUMENTS

DE 4114632 * 11/1992 ..... H01H 33/53
DE 19910166 * 9/2000 ..... H01H 2033/906
(Continued)

OTHER PUBLICATIONS

Translation DE19910166 (Original document published Sep. 21, 2000) (Year: 2000).*
(Continued)

*Primary Examiner* — William A Bolton
(74) *Attorney, Agent, or Firm* — Eversheds Sutherland (US) LLP

(57) ABSTRACT

Embodiments of the disclosure include systems and methods for providing an electric high-voltage circuit breaker. In one embodiment, a circuit breaker includes a primary chamber; and a compression chamber, wherein the circuit breaker further includes a valve configured to control a fluid flow between the primary chamber and the compression chamber, wherein the valve includes a valve body, a first valve plate that is arranged axially movable with respect to the valve body, and a second valve plate that is arranged between and movable with respect to the valve body and the first valve plate, wherein said first valve plate includes at least one opening enabling the fluid flow through the first valve plate,
(Continued)

wherein a first surface of the valve body forms a valve seat for the first valve plate, and wherein a first surface of the first valve plate forms a valve seat for the second valve plate.

13 Claims, 8 Drawing Sheets

(58) Field of Classification Search
USPC ..... 218/66, 57, 59–61, 67, 68, 76, 78
See application file for complete search history.

(56) References Cited

U.S. PATENT DOCUMENTS

| | | | | |
|---|---|---|---|---|
| 5,898,149 | A * | 4/1999 | Berger | H01H 33/904 218/60 |
| 6,624,371 | B2 * | 9/2003 | Dufournet | H01H 33/901 218/59 |
| 8,299,385 | B2 * | 10/2012 | Bae | H01H 33/70 218/66 |
| 8,410,388 | B2 * | 4/2013 | Kriegel | H01H 33/901 218/109 |
| 8,546,716 | B2 * | 10/2013 | Nufer | H01H 33/901 218/43 |
| 8,822,868 | B2 * | 9/2014 | Kehr | H01H 33/901 218/66 |
| 2011/0056915 | A1 | 3/2011 | Bae et al. | |
| 2011/0163069 | A1 * | 7/2011 | Ohlsson | H01H 33/901 218/66 |
| 2012/0056915 | A1 | 3/2012 | Shibazaki et al. | |

FOREIGN PATENT DOCUMENTS

| | | | |
|---|---|---|---|
| EP | 0634049 | B1 | 5/1996 |
| WO | 2012/123032 | A1 | 9/2012 |

OTHER PUBLICATIONS

Translation DE4114632 (Original document published Nov. 5, 1992) (Year: 1992).*
International Search Report of PCT/EP2018/065323 dated Aug. 8, 2018.
European Search Report of EP17176899.7 dated Nov. 30, 2017.

* cited by examiner

ELECTRIC HIGH-VOLTAGE CIRCUIT BREAKER

CROSS-REFERENCE TO RELATED APPLICATIONS

This application is a U.S. National Stage Application under 35 U.S.C. 371 and claims the priority benefit of International Application No. PCT/EP2018/065323, filed Jun. 11, 2018, which claims priority to EP17176899.7, filed Jun. 20, 2017, which are both incorporated herein by reference.

FIELD OF THE INVENTION

The disclosure relates to an electric high-voltage circuit breaker comprising a primary chamber and a compression chamber, wherein said circuit breaker further comprises a valve configured to control a fluid flow between said primary chamber and said compression chamber.

BACKGROUND

A conventional circuit breaker of the aforementioned type is disclosed by EP 0 634 049 B1. The conventional circuit breaker comprises a valve device having two concentric ring-type discs. Disadvantageously, a valve seat for the larger ring type disc is formed by a limit stop which is part of a piston head of said circuit breaker. This requires the portion of the piston head forming said valve seat for the larger ring type disk to be manufactured with the same tolerance as the remaining valve components having sealing surfaces. In other words, with the conventional design, the tolerance chain not only includes components of the valve device as such, but also of other hardware of the circuit breaker such as the piston head. Moreover, the conventional design requires a complex and delicate assembly, as the orientation of the conventional valve and especially its larger ring type disk has to be fine-tuned with respect to the limit stop of the piston head to ensure proper sealing.

SUMMARY

In view of this, various embodiments provide an improved electric high-voltage circuit breaker of the aforementioned type.

Some embodiments feature an electric high-voltage circuit breaker comprising a primary chamber and a compression chamber, wherein said circuit breaker further comprises a valve configured to control a fluid flow between said primary chamber and said compression chamber, wherein said valve comprises a valve body, a first valve plate that is arranged axially movable with respect to said valve body, and a second valve plate that is arranged between and movable, preferably at least axially movable, with respect to said valve body and said first valve plate, wherein said first valve plate comprises at least one opening enabling a fluid flow through said first valve plate, wherein a first surface of said valve body forms a valve seat for said first valve plate, and wherein a first surface of said first valve plate forms a valve seat for said second valve plate. This advantageously enables to limit the tolerance chain for sealing surfaces of the valve seats to components of the valve itself, particularly not including other components of the circuit breaker, such as required with the conventional system.

In other words, the valve of the circuit breaker according to the embodiments requires specific tolerances for sealing surfaces for the valve operation to be provided only within the components of the valve itself. Other components of the circuit breaker do not contribute to constituting a valve seat for the valve and may thus have other tolerances (usually more relaxed, as compared to the components forming the valve seats). This also enables to easily assemble (and optionally test) the valve according to the embodiments in advance, i.e. prior to integrating it into the target system such as the circuit breaker.

According to an embodiment, the circuit breaker is configured to provide a self-generated quenching gas flow which enables to blow out or extinguish an electric arc that may form between contact elements of the circuit breaker during a switch-off operation of the circuit breaker. This technology is well-known in the field and may also be denoted as "self-blast technology". According to an embodiment, the quenching gas may e.g. comprise Sulfur hexafluoride ($SF_6$). According to further embodiments, the quenching gas may also comprise other suitable gases or mixtures thereof.

As mentioned above, according to the embodiments, the valve is configured to control a fluid flow between the primary chamber and a compression chamber of the circuit breaker. As an example, the valve may control a flow of the quenching gas from the primary chamber to the compression chamber and/or vice versa. According to an embodiment, the primary chamber may e.g. be formed by a housing or a component of a housing of said circuit breaker, for example by insulators such as column insulators.

According to an embodiment, in a first operational state, the valve may be closed thus neither enabling a fluid flow from the primary chamber to the compression chamber nor enabling a fluid flow from the compression chamber to the primary chamber.

According to a further embodiment, in a second operational state, the valve may be opened such that a fluid flow from the primary chamber to the compression chamber is enabled. This may be the case if a pressure of the quenching gas in the primary chamber is greater than a pressure of the quenching gas in the compression chamber. This operational state may also be denoted as "filling state" as it enables to fill or refill, respectively, the compression chamber of the circuit breaker with "fresh" quenching gas from the primary chamber. According to some embodiments, the filling state can be attained by effecting an increase of the volume of the compression chamber, which may result from a corresponding relative movement of components of the circuit breaker which delimit said primary chamber and/or said compression chamber.

According to a further embodiment, in a third operational state, the valve may be opened such that a fluid flow from the compression chamber to the primary chamber is enabled. This may be the case if a pressure of the quenching gas in the compression chamber is greater than a pressure of the quenching gas in the primary chamber. This operational state may also be denoted as "discharge state" as excessive pressure within the compression chamber is released into the primary chamber through the valve. As an example, the discharge state occurs from respective relative movement of components of the circuit breaker which delimit said primary chamber and/or said compression chamber.

According to some embodiments, state transitions between said abovementioned three operational states may be initiated by generating positive or negative (or vanishing) pressure differences of the quenching gas in said primary chamber and said compression chamber, which may e.g. be caused by driving a movement of movable parts of the circuit breaker influencing a chamber volume of at least one of said chambers.

As an example, the valve according to the embodiments may also be considered as a combined valve, particularly a combined filling and discharge valve, as it enables a filling operation in the filling state and a discharge operation of the compression chamber in the discharge state.

According to some embodiments, the electric high-voltage circuit breaker is configured to operate at voltage levels between about 72.5 kV (kilovolt) and 170 kV. According to further embodiments, lower and/or higher operating voltage levels are also possible. As an example, the electric high-voltage circuit breaker may be configured to perform switching operations (switching on and/or off) under regular load conditions (with currents of e.g. 2000 A (Ampere)) and/or short-circuit conditions (with currents of up to e.g. 63 kA kiloampere).

Further embodiments propose that said valve seat for said second valve plate is formed such that said second valve plate may be pressed to said valve seat of the first valve plate in a sealing manner sealing said at least one opening of said first valve plate. In the further description, the valve seat provided at said valve body for said first valve plate is also denoted as "first valve seat", and the valve seat provided at said first valve plate for said second valve plate is also denoted as "second valve seat".

Further embodiments propose that said first valve plate comprises a basically circular ring shape. According to a further embodiment, said circular ring shape of said first valve plate may comprise a basically rectangular cross-section, defining a thickness along an axial direction of the valve or the circuit breaker, respectively, and defining a radial extension in a radial direction perpendicular to said axial direction.

Further embodiments propose that said second valve plate comprises a basically circular ring shape. According to a further embodiment, said circular ring shape of said second valve plate may comprise a basically rectangular cross-section, defining a thickness along an axial direction of the valve all the circuit breaker, respectively, and defining a radial extension in a radial direction perpendicular to said axial direction.

According to further embodiments, an outer diameter of said second valve plate is smaller than an outer diameter of said first valve plate, which enables a particularly small configuration and, in combination with specific embodiments of the valve body, also reduced dimensions along the axial direction, combined with an increased flow cross-section for a fluid flow through said valve in an open state (i e, filling state and discharge state).

According to further embodiments, an inner diameter of said second valve plate is larger than an inner diameter of said first valve plate. In other words, the circular ring shape of the second valve plate comprises a smaller radial extension than the circular ring shape of the first valve plate according to this embodiment. Thus, advantageously, radial inner and outer fluid channels are formed for the filling state of the valve, i.e. if the second valve plate is lifted off its valve seat (the second valve seat) provided at said first surface of said first valve plate.

According to further embodiments, said at least one opening of said first valve plate is provided in a radially intermediate section of said first valve plate, which enables a particularly efficient fluid flow through said first valve plate whenever the second valve plate is lifted off its valve seat provided at said first surface of said first valve plate.

According to further embodiments, said valve body comprises a basically circular ring shape. According to some embodiments, the valve body comprises a substantially rectangular cross-section. According to further preferred embodiments, said valve body comprises a substantially "C"-shaped cross-section, wherein a concave side of said "C"-shaped cross-section faces said first and second valve plates, which enables a particularly small configuration.

Further embodiments propose that said valve body comprises at least one opening enabling a fluid flow through said valve body, preferably in a basically axial direction.

According to further embodiments, said at least one opening of said valve body is provided in a radially intermediate section of said valve body, which enables a particularly efficient fluid flow through said valve body in an open state (i e, filling state and discharge state).

Further embodiments propose that at least one of said openings of said valve body comprises a radial extension that is equal to or greater than about 50% of a radial extension of said circular ring shape of said valve body. If said at least one opening is arranged in a radially intermediate section of said valve body as mentioned above, thus, radially inner and outer sections of the valve body limiting said radially intermediate opening may together comprise up to about 50% of said radial extension of said circular ring shape of said valve body.

According to particularly preferred embodiments, at least one of said openings comprises a radial extension that is equal to or greater than about 70% of said radial extension of said circular ring shape of said valve body, which enables a particularly large flow cross-section for a fluid flow (e.g., of quenching gas) through said valve body, advantageously effecting a particularly small flow resistance. Thus, a reduced amount of driving energy for driving the movement of the movable parts delimiting the primary chamber and/or the compression chamber of the circuit breaker is required.

Further embodiments propose that said at least one opening of said valve body extends over an angular range of at least about 60° (degrees), preferably of at least about 75°.

Further embodiments propose that an aggregated area of said one or more openings of the valve body is equal to or greater than about 50% of an overall area of said circular ring shape of said valve body, wherein a particularly small flow resistance for a fluid flow through said valve body (in both the filling state and the discharge state) is attained.

Further embodiments propose that said valve body comprises one or more guide pins for guiding an axial movement of said first valve plate, which enables a particularly reliable and error-free operation of the valve. According to some embodiments, the guide pins may comprise one or more bolts. According to further embodiments, at least one of the bolts may form an integral part of said valve body. According to further embodiments at least one of the bolts may be a threaded bolt, e.g. being releasably attachable to the valve body.

According to further embodiments said valve body may comprise one or more guide pins for guiding an axial movement of said second valve plate. According to some embodiments, the guide pins for the second valve plate may comprise one or more bolts. According to further embodiments, at least one of the bolts may form an integral part of said valve body. According to further embodiments at least one of the bolts may be a threaded bolt, e.g. being releasably attachable to the valve body.

According to a particularly preferred embodiment, one or more guide pins may be provided for guiding an axial movement of both said first valve plate and said second valve plate, which results in a particularly simple and cost-efficient construction.

According to some embodiments, the first valve plate and/or the second valve plate may comprise respective guiding openings for receiving the guide pins.

According to further embodiments, the second valve plate may also be guided by radially surrounding wall sections of said valve body and/or said first valve plate, particularly if said valve body and/or said first valve plate comprise a "C"-shaped cross-section or other type of cross-sectional shape having an opening for at least partially receiving said second valve plate. In this case, according to some embodiments, no guide pins are provided for additional guiding said second valve plate. However, according to further embodiments, additional guide pins may be provided for said second valve plate, too.

According to further embodiments, said one or more guide pins are arranged in a radially intermediate section of said valve body (similar to said one or more openings of said valve body, according to some embodiments), which provides a particularly reliable guiding mechanism for said first valve plate and/or said second valve plate. As an example, if said one or more guide pins and said one or more openings of said valve body are arranged in said radially intermediate section of the valve body, said guide pins and said openings may be provided at different angular ranges each, e.g. one guide pin between two adjacent openings.

Further embodiments propose that a first spring force mechanism is provided to press said first valve plate to said valve seat of the valve body. According to an embodiment, the spring force mechanism may comprise one or more springs (for example helical springs) arranged at said guide pins. As an example, according to some embodiments, at least one of said guide pins may comprise at a first axial and section arranged distal from said valve body a shoulder capable of receiving a first front face of a corresponding spring, the second front face of said spring resting on an opposing front surface of said first valve plate. By selecting the modulus of resilience of said springs, a discharge pressure may be controlled at which said valve transitions from a closed state to the discharge state.

Further embodiments propose to provide a second spring force mechanism to press said second valve plate to said valve seat of the first valve plate. This way, the opening(s) within said first valve plate may be sealingly covered and closed by means of said second valve plate with a defined force thus enabling to control a pressure difference between the primary chamber and the compression chamber to effect a state transition from a first operational state (closed valve) to the filling state.

According to further embodiments, however, the second valve plate may move basically freely between the valve body and its valve seat at the first valve plate, thus forming a type of "flap valve", the movement of which may be influenced by a pressure difference between the adjacent chambers and/or gravity and/or an existing fluid flow around said second valve plate.

Further embodiments propose that said second valve plate together with said first valve plate forms a filling valve configured to enable a fluid flow from said primary chamber to said compression chamber if a fluid pressure in said primary chamber is greater than a fluid pressure in said compression chamber. As both the first valve plate and the second valve plate, which form said filling valve according to an embodiment are arranged axially movable with respect to said valve body, the configuration may also be denoted as "mobile filling valve".

Further embodiments propose that the second valve plate together with said first valve plate and the valve body form a discharge valve configured to enable a fluid flow from said compression chamber to said primary chamber if a fluid pressure in said compression chamber is greater than a fluid pressure in said primary chamber.

Although the valve according to the embodiments is particularly useful for integration into the abovementioned circuit breaker, according to a further aspect of the disclosure, it is also possible to use the valve in other systems where a fluid flow, particularly gas flow, is to be controlled.

BRIEF DESCRIPTION OF THE FIGURES

Further features, aspects and advantages of the illustrative embodiments are given in the following detailed description with reference to the drawings in which.

DESCRIPTION OF THE EMBODIMENTS

Figure 1A:
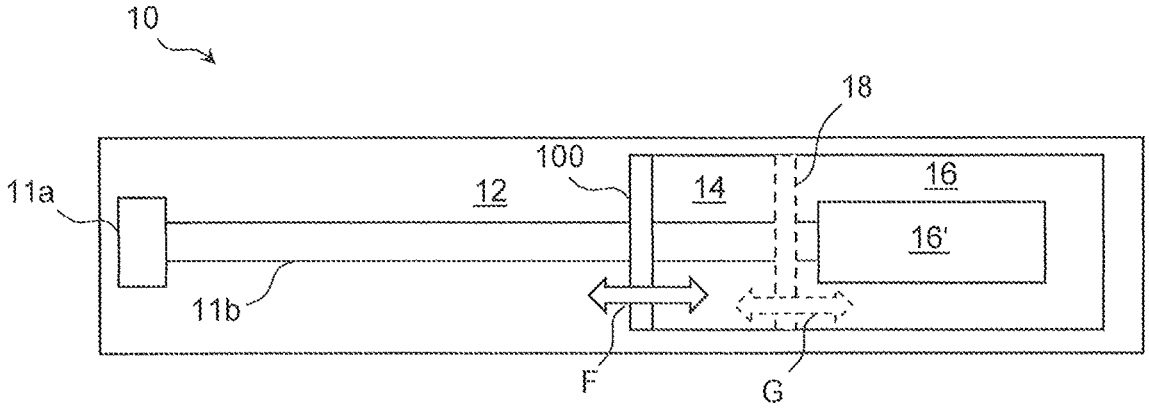
FIG. 1A schematically depicts a simplified side view of an electric high-voltage circuit breaker according to an embodiment, FIG. 1B schematically depicts a more detailed view of a circuit breaker according to an embodiment, FIG. 1C schematically depicts a detail of FIG. 1B, FIG. 2A schematically depicts a perspective view in partial cross-section of a valve according to an embodiment in a first operational state, FIG. 2B schematically depicts the valve of FIG. 2A in a second operational state, FIG. 2C schematically depicts the valve of FIG. 2A in a third operational state, FIG. 3A schematically depicts a cross-sectional side view of a valve according to an embodiment, FIG. 3B schematically depicts a cross-sectional view of the plane B-B of FIG. 3A, FIG. 3C schematically depicts a cross-sectional view of the plane C-C of FIG. 3A, FIG. 3D schematically depicts a front view of the valve of FIG. 3A, FIG. 3E schematically depicts a rear view of the valve of FIG. 3A, FIG. 4 schematically depicts a detail of a cross-sectional side view of a valve according to an embodiment, FIG. 5A schematically depicts a detail of a cross-sectional side view of a valve according to a further embodiment, and FIG. 5B schematically depicts a detail of a cross-sectional side view of a valve according to a further embodiment.

FIG. 1A schematically depicts a simplified side view of an electric high-voltage circuit breaker 10 according to an embodiment. The circuit breaker 10 comprises a primary chamber 12 defining a first volume within a housing of said circuit breaker 10 that may be filled with quenching gas such as $SF_6$ in a per se known manner. The circuit breaker 10 further comprises a compression chamber 14 defining a second, preferably variable, volume that may also be filled with said quenching gas for providing a certain amount of quenching gas at a certain pressure, which enables to supply pressurized quenching gas to an interrupter section 16 of said circuit breaker 10 for extinguishing an electric arc (not shown in FIG. 1A) that may form between contact elements 16' of said circuit breaker 10 arranged in said interrupter section 16 especially during a switch-off or disconnecting operation of the circuit breaker 10.

According to the embodiments, said circuit breaker 10 comprises a valve 100 which is arranged between said primary chamber 12 and said compression chamber 14 and which is configured to control a fluid flow F between said primary chamber 12 and said compression chamber 14, i.e. in both directions.

According to an embodiment, in a first operational state, the valve 100 may be closed thus preventing any fluid flow from the primary chamber 12 to the compression chamber 14 and from the compression chamber 14 to the primary chamber 12. This first operational state may also be considered as an idle state of said valve 100. According to a further embodiment, in a second operational state, a filling state, the valve 100 may be opened such that a fluid flow F from the primary chamber 12 to the compression chamber 14 is enabled. This may e.g. be the case if a pressure of the quenching gas in the primary chamber 12 is greater than a pressure of the quenching gas in the compression chamber 14. The filling state may be employed to fill or refill, respectively, the compression chamber 14 of the circuit breaker 10 with "fresh" quenching gas from the primary chamber 12. According to some embodiments, the filling state can be attained by effecting an increase of the volume of the compression chamber 14, which may result from a corresponding relative movement of components of the circuit breaker 10 which define or delimit said primary chamber 12 and/or said compression chamber 14 in a per se known manner. According to a further embodiment, in a third operational state, a discharge state, the valve 100 may be opened such that a fluid flow F from the compression chamber 14 to the primary chamber 12 is enabled. This may e.g. be the case if a pressure of the quenching gas in the compression chamber 14 is greater than a pressure of the quenching gas in the primary chamber 12. The discharge state is employed to release excessive pressure within the compression chamber 14 into the primary chamber 12 through the valve 100.

In view of the various functions of the valve 100 according to the embodiments, it may also be considered as a combined valve, particularly a combined filling and discharge valve, as it enables a filling operation by assuming the filling state and a discharge operation of the compression chamber by assuming the discharge state.

According to a further embodiment, optionally, a further valve 18, which may also be denoted as "thermal valve", may be provided to control a fluid flow G between said compression chamber 14 and a so-called thermal volume corresponding with the interrupter section 16. The thermal volume is a volume of the circuit breaker 10 surrounding the contact elements 16', which are not depicted in detail in FIG. 1A for the sake of clarity.

The circuit breaker 10 also comprises a drive unit 11*a* for driving a movement of a drive rod 11*b* in a horizontal direction of FIG. 1A, wherein said drive rod 11*b* in turn moves at least one movably arranged component, particularly a movable contact element 16' of the circuit breaker 10, to effect a switching operation (i.e., switching on ("connecting") or switching off ("disconnecting")) in a per se known manner.

Figure 1B:
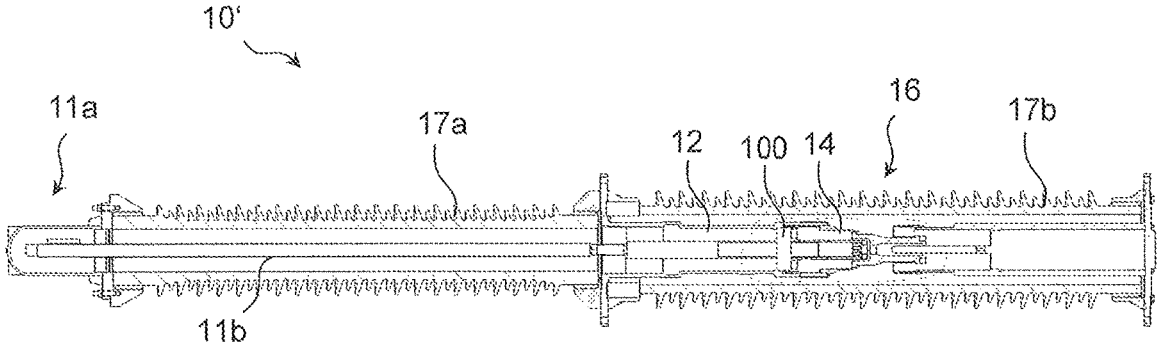

FIG. 1B schematically depicts a more detailed view of a circuit breaker 10' according to an embodiment. Particularly, FIG. 1B also depicts insulators 17*a*, 17*b* forming a housing for the components of the circuit breaker as already explained above with reference to FIG. 1A.

Figure 1C:
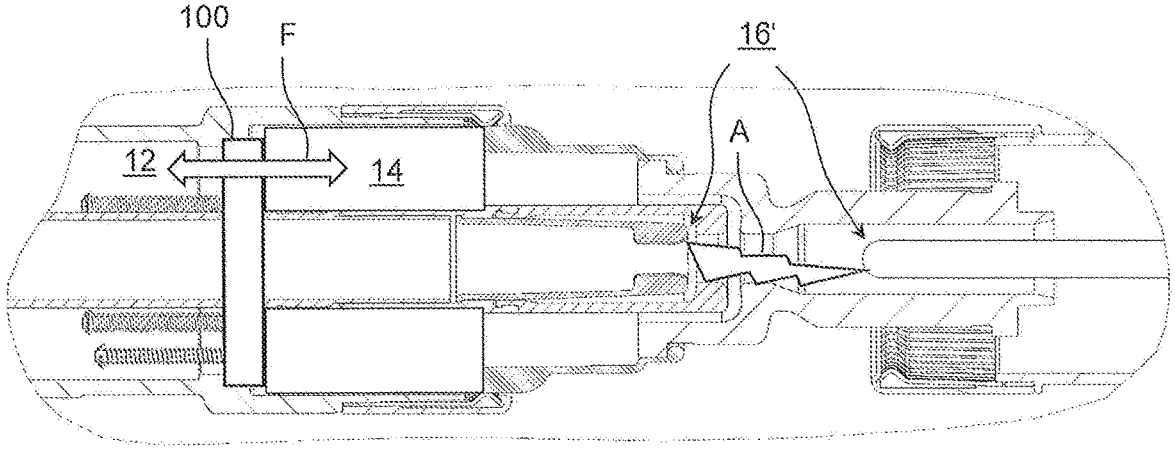

FIG. 1C schematically depicts a detail of FIG. 1B. Also depicted in FIG. 1C is an electric arc A that is formed between the contact elements 16' during a disconnecting operation of the circuit breaker. Note that the optional thermal valve 18, cf. FIG. 1A, is not depicted in FIGS. 1B, 1C, but may nevertheless be present in the circuit breaker 10' of these FIGS. 1B, 1C.

As an example, the circuit breakers 10, 10' of FIGS. 1A and 1B may also be denoted as a "live tank circuit breaker" comprising a "candle stick" design. According to some embodiments, the circuit breakers 10, 10' may be configured to provide a self-generated quenching gas flow ("self-blast technology") which enables to blow out or extinguish an electric arc that may form between the contact elements 16' of the circuit breaker during a switch-off (disconnecting) operation of the circuit breaker.

According to some embodiments, the electric high-voltage circuit breaker 10, 10' is configured to operate at voltage levels between about 60 kV (kilovolt) and 170 kV, e.g. 145 kV. According to further embodiments, lower and/or higher operating voltage levels are also possible. As an example, the electric high-voltage circuit breaker 10, 10' may be configured to perform switching operations (switching on and/or off) under regular load conditions (with currents of e.g. up to 2000 A (Ampere)) and/or short-circuit conditions (with currents of up to e.g. 63 kA kiloampere). As an example, the circuit breaker 10, 10' may e.g. form part of a pole column or pole of a multi-phase high-voltage switching device, wherein one circuit breaker 10, 10' is assigned to each electrical phase of the switching device. In many applications, three-phase switching devices may be provided. In other applications, single (i.e., one) phase or two-phase switching devices may be provided. According to further embodiments, the circuit breaker 10, 10' may also be combined with a separate grounding switch for electrically grounding at least one terminal of said circuit breaker 10, 10' and/or with a separate disconnector for disconnecting at least one terminal of said circuit breaker 10, 10'. According to further embodiments, the circuit breaker 10, 10' may also be designed as a circuit breaker with internal disconnecting function.

In the following, an example of a switching cycle of the circuit breaker 10, 10' according to an embodiment is explained.

During a trip operation of the drive rod 11*b*, the volume of the compression chamber 14 is reduced, which leads to an increase of the pressure of the quenching gas inside said compression chamber 14. Consequently, pressurized quenching gas may be transmitted from compression chamber 14 via the optional thermal valve 18 (FIG. 1A) to a nozzle area (not depicted) surrounding the contact elements 16' of said circuit breaker 10 for extinguishing an electric arc A, cf. FIG. 1C, that may form between the contact elements 16'.

During a closing operation, the volume of the compression chamber 14 ("compression volume") increases, and the compression volume has to be (re-)filled with "fresh" quenching gas ("filling process"), which is provided from said primary chamber 12 to said compression chamber 14 via said valve 100. The filling process consumes energy which has to be provided by the drive unit 11*a*.

According to further embodiments, especially in the case of short-circuit with comparatively large short circuit currents, the energy of the electric arc A (FIG. 1C) energizes the surrounding (originally fresh) quenching gas comprised within the thermal volume of the interrupter section 16 surrounding the contact elements 16', which quenching gas has been filled into said thermal volume in a preceding filling process as explained above. As a consequence, the pressure in the thermal volume increases, and, particularly at a zero crossing of the current ("current zero") through the circuit breaker 10, is transmitted to a nozzle area of the contact elements 16' to extinguish the electric arc A. During this process, the quenching gas in the compression volume 14 is "trapped" and should be released to the primary chamber 12 again, to avoid an excessive pressure on the compression chamber 14, which would result in a substantially increased amount of driving energy required for moving the movable part(s) of the interrupter section 16 of the circuit breaker 10. The releasing of pressurized quenching gas from the compression chamber 14 to the primary chamber 12 can be effected by employing the discharge state of the valve 100.

Figure 2A:
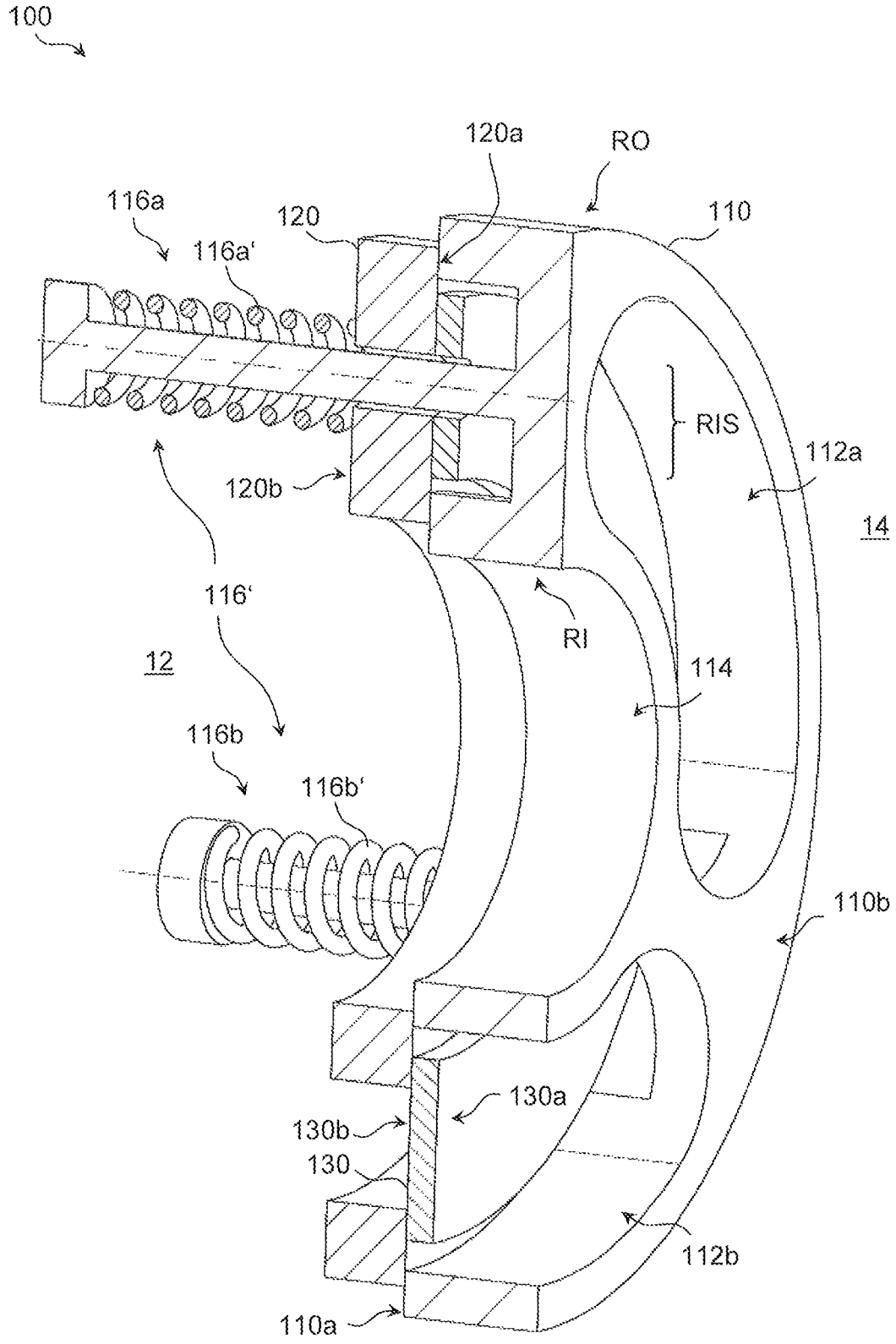
Figure 3A:
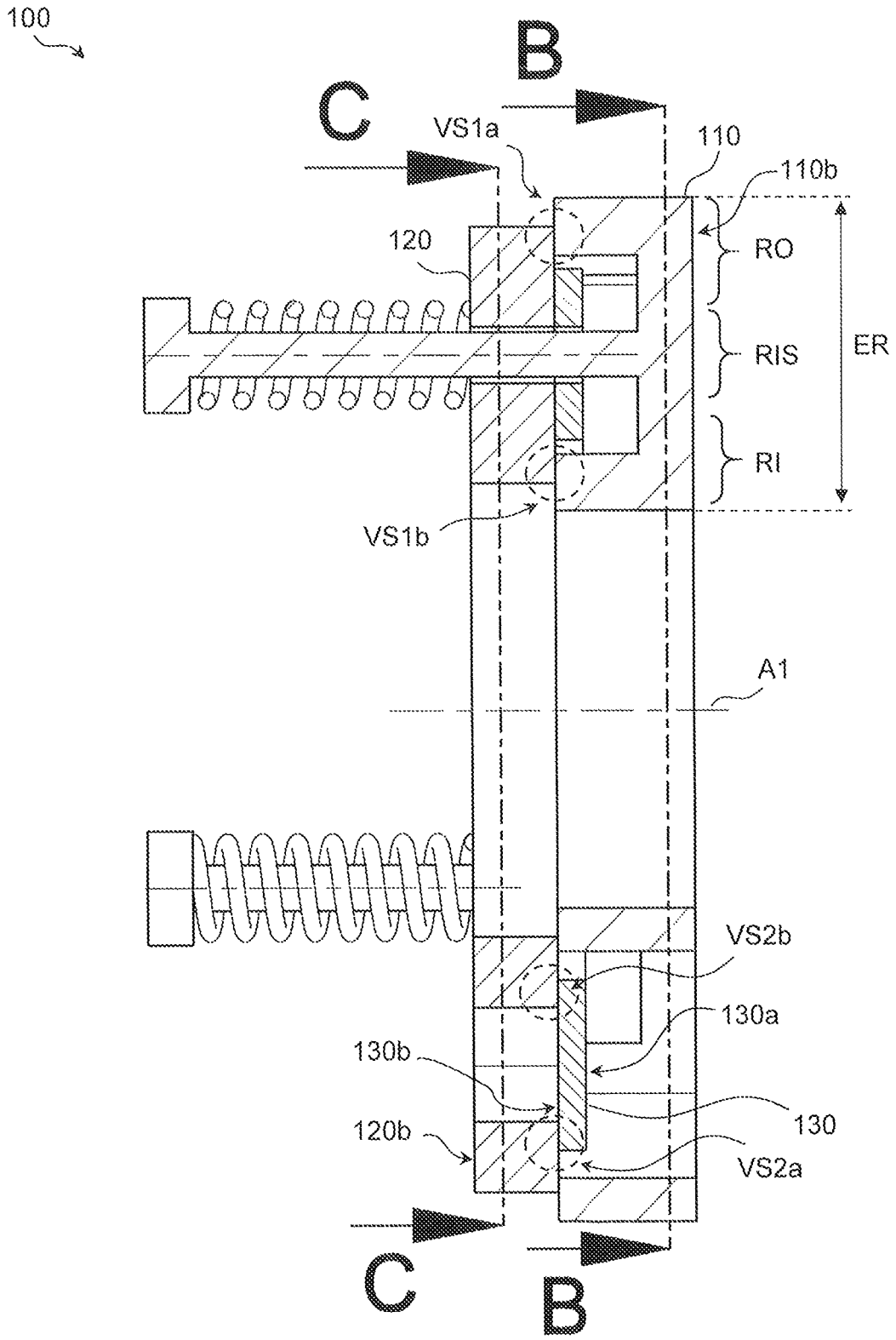

FIG. 2A schematically depicts a perspective view in partial cross-section of the valve 100 according to an embodiment in a first operational state, namely the idle state. A cross-sectional side view is provided by FIG. 3A, and cross-sectional views along the planes B-B and C-C of FIG. 3A, are respectively provided by FIG. 3B and FIG. 3C.

As mentioned above, in the idle state, the valve 100 (FIG. 2A) prevents any fluid flow (i.e., flow of quenching gas) from the primary chamber 12 to the compression chamber 14 and vice versa. As can be seen from FIG. 2A, the valve 100 comprises a valve body 110, a first valve plate 120 that is arranged axially movable with respect to said valve body 110, and a second valve plate 130 that is arranged between and movable with respect to said valve body 110 and said first valve plate 120. As can best be seen from the partial cross-sectional view of FIG. 3C, the first valve plate 120 comprises at least one opening, presently three openings 122*a*, 122*b*, 122*c*, enabling a fluid flow through said first valve plate 120, for example in a basically axial direction of said circuit breaker 10 (FIG. 1A).

Returning to FIG. 2A, a radially outer surface, cf. arrow RO, of the valve body 110 may contact a surrounding surface (not shown) of the circuit breaker in a sealing (substantially gas-tight) manner. Similarly, a radially inner surface, cf. arrow RI, of the valve body 110 may contact a radially outer surface of the drive rod 11*b* (FIG. 1A) or an extension of said drive rod protruding through said central, radially inner opening 114 (FIG. 2A) of the valve body 110 in a sealing manner. As an example, at either surface RO, RI, suitable sealing may be provided such as sealing rings and the like. Hence, a fluid flow between the chambers 12, 14 is only possible via the valve 100, particularly through openings 112*a*, 112*b* of the valve body, in some operational states of said valve 100.

According to the principle of the embodiments, a first surface 110*a* of said valve body 110 forms a valve seat (in the following also denoted as "first valve seat") for said first valve plate 120, and a first surface 120*a* of said first valve plate 120 forms a valve seat (in the following also denoted as "second valve seat") for said second valve plate 130. This can also be seen from FIG. 3A, wherein a radially outer portion of the first valve seat is indicated with reference sign VS1*a*, and wherein a radially inner portion of the first valve seat is indicated with reference sign VS1*b*. Similarly, a radially outer portion of the second valve seat is indicated with reference sign VS2*a*, and a radially inner portion of the second valve seat is indicated with reference sign VS2*b* in FIG. 3A.

It can be seen that according to the present embodiment, the first valve seat comprises two circular ring-shaped sealing areas VS1*a*, VS1*b* defined by the contacting surface portions of the components 110, 120. Similarly, the second valve seat also comprises two circular ring-shaped sealing areas VS2*a*, VS2*b* defined by the contacting surface portions of the components 120, 130.

This advantageously enables to limit the tolerance chain for sealing surfaces of the valve seats to the components 110, 120, 130 of the valve 100 itself, particularly not including any other components of the circuit breaker 10, 10', such as required with the conventional systems. In other words, the valve 100 of the circuit breaker 10, 10' according to the embodiments requires specific tolerances for sealing surfaces for the valve operation to be provided only within the components 110, 120, 130 of the valve 100 itself. This also enables to assemble the valve 100 in advance, i.e. prior to integrating it into a target system such as the circuit breaker 10. Moreover, no complicated adjustment of the valve 100 or its components 110, 120, 130 with respect to other components of the target system 10, 10' is required, apart from introducing the drive rod 11*b* (FIG. 1A) through the opening 114 (FIG. 2A) of the valve body 110.

Figure 4:
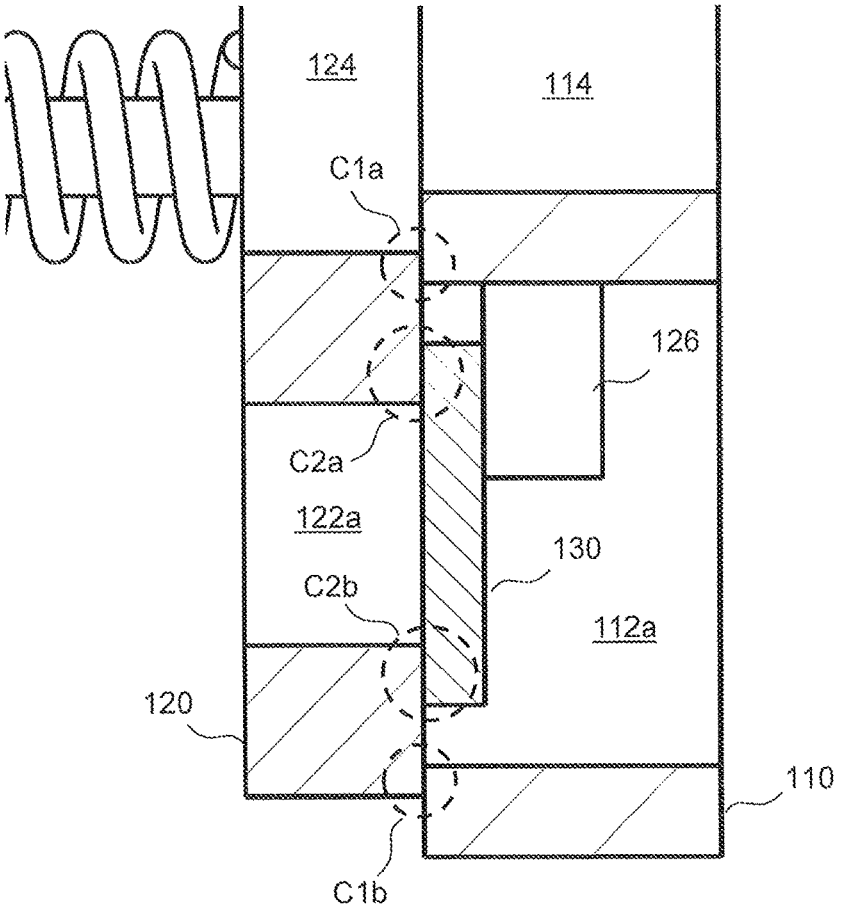

FIG. 4 depicts details of the respective contact surfaces between the components 110, 120, cf. reference signs C1*a*, C1*b*, and between the components 120, 130, cf. reference signs C2*a*, C2*b*.

According to an embodiment, said second valve seat (cf. reference signs VS2*a*, VS2*b* of FIG. 3A) for said second valve plate 130 is formed such that said second valve plate 130 may be pressed to said valve seat of the first valve plate in a sealing manner sealing said at least one opening 122*a*, 122*b*, 122*c* (FIG. 3C) of said first valve plate 120.

Figure 3B:
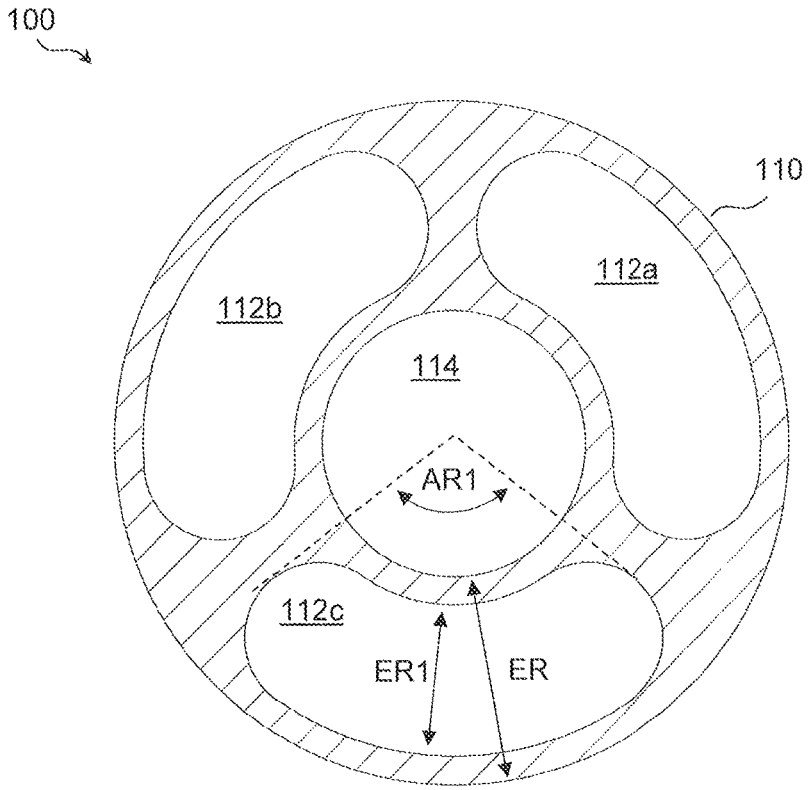
Figure 3C:
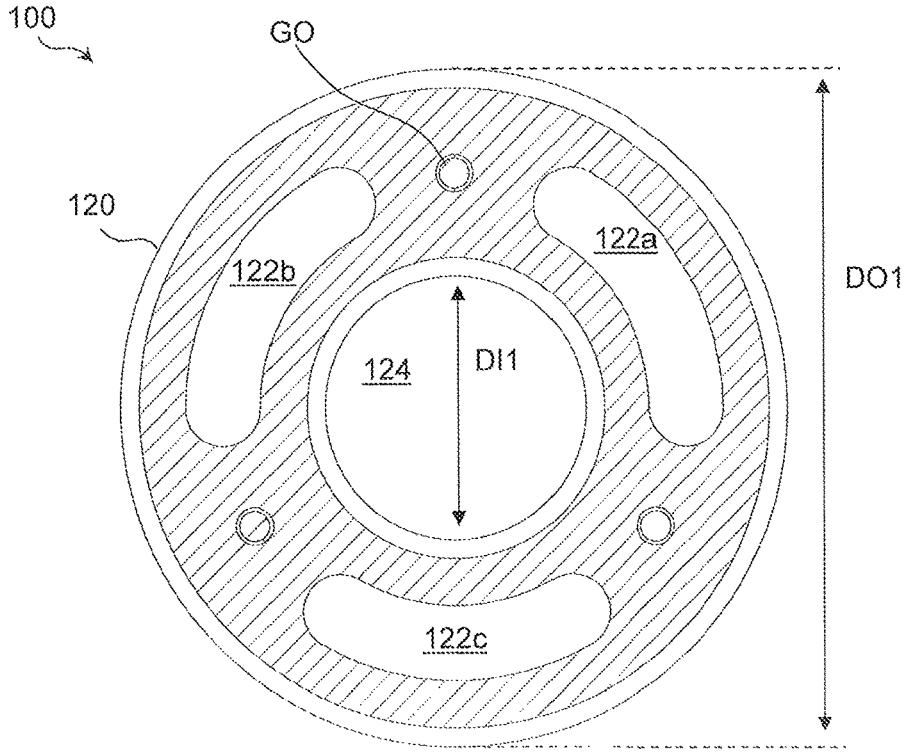

Further embodiments propose that said first valve plate 120 comprises a basically circular ring shape, cf. FIG. 2A, defining a basically circular radially inner opening 124, cf. FIG. 3C. According to a further embodiment, said circular ring shape of said first valve plate 120 may comprise a basically rectangular cross-section, defining a thickness along an axial direction A1 (FIG. 3A) of the valve 100 or the circuit breaker 10, 10', respectively, and defining a radial extension in a radial direction perpendicular to said axial direction A1. A first surface 120*a* (FIG. 2A) of said first valve plate 120 comprises the second valve seat as already explained above. Also, radially inner and outer portions of said first surface 120*a* of said first valve plate 120 form contact surfaces for contacting in a sealing manner the first valve seat provided by the first surface 110*a* of said valve body 110. A second surface of the first valve plate 120 is denoted with reference sign 120*b*; it faces the primary chamber 12. Similarly, a second surface 110*b* of the valve body 110 faces the compression chamber 14.

Further embodiments propose that said second valve plate 130 (FIG. 2A) comprises a basically circular ring shape, too. According to a further embodiment, said circular ring shape of said second valve plate 130 may comprise a basically rectangular cross-section, defining a thickness along an axial direction A1 (FIG. 3A) of the valve 100 or the circuit breaker, respectively, and defining a radial extension in a radial direction perpendicular to said axial direction A1. First and second surfaces of said second valve plate 130 are denoted with reference signs 130*a*, 130*b* in FIG. 2A.

Figure 3D:
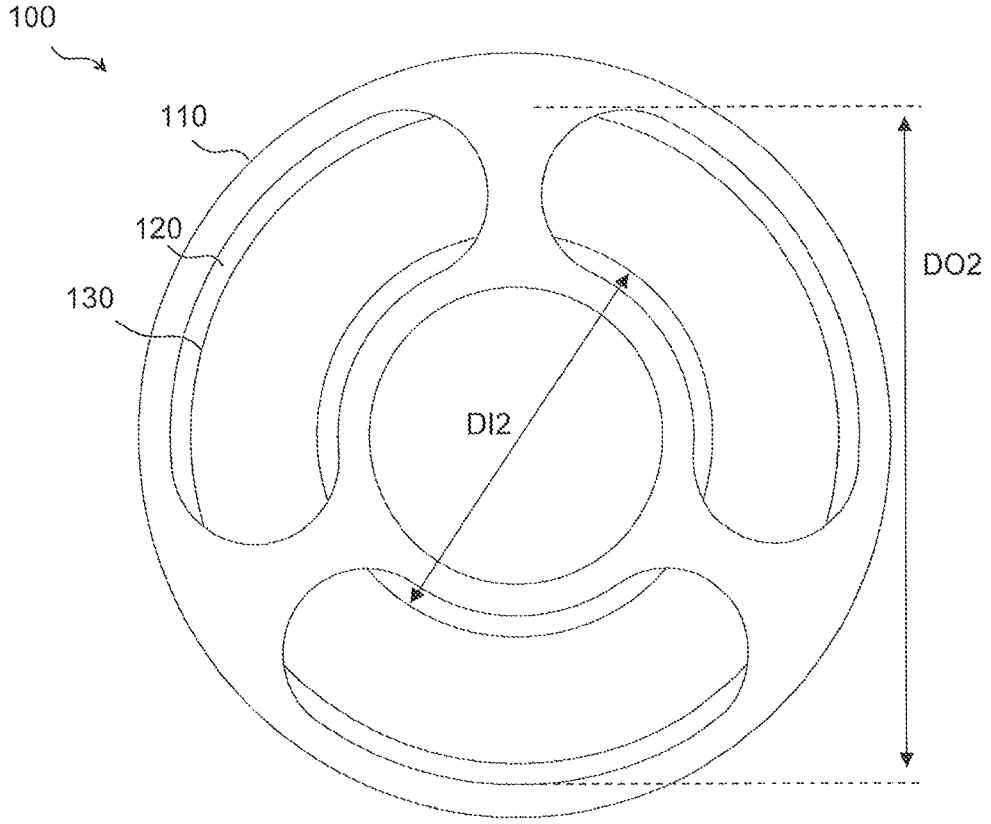
Figure 3E:
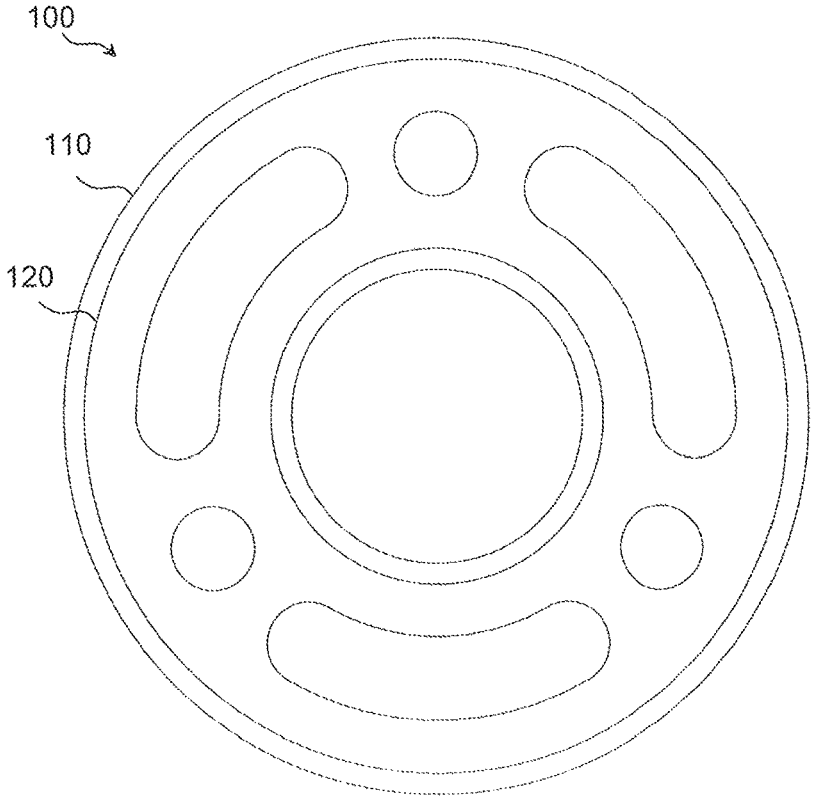

According to further embodiments, an outer diameter DO2 of said second valve plate 130, cf. FIG. 3D, is smaller than an outer diameter DO1 of said first valve plate 120, cf. FIG. 3C, which enables a particularly small configuration and, in combination with specific embodiments of the valve body 110, also reduced dimensions along the axial direction A1 (FIG. 3A).

According to further embodiments, an inner diameter DI2 (FIG. 3D) of said second valve plate 130 is larger than an inner diameter DI1 (FIG. 3C) of said first valve plate 120. In other words, the circular ring shape of the second valve plate 130 comprises a smaller radial extension (i.e., extension of material of the respective valve plate along a radial direction) than the circular ring shape of the first valve plate 120 according to this embodiment. Thus, advantageously, radial inner and outer fluid channels are formed for the filling state of the valve, i.e. if the second valve plate is lifted off its valve seat (the second valve seat) provided at said first surface of said first valve plate, cf. FIG. 2B.

According to further embodiments, said at least one opening 122*a*, 122*b*, 122*c* (FIG. 3C) of said first valve plate 120 is provided in a radially intermediate section of said first valve plate 120, which enables a particularly efficient fluid flow through said first valve plate 120 whenever the second valve plate 130 is lifted off its valve seat.

According to further embodiments, said valve body 110 comprises a basically circular ring shape, cf. FIG. 2A, defining a basically circular radially inner opening 114, cf. FIG. 3B. According to some embodiments, the valve body 110 comprises a substantially rectangular cross-section (cf. e.g. the embodiments 110', 110" according to FIG. 5A, 5B). According to preferred embodiments, said valve body 110 comprises a substantially "C"-shaped cross-section, cf. FIG. 2A, wherein a concave side of said "C"-shaped cross-section faces said first and second valve plates 120, 130, which enables a particularly small configuration.

Further embodiments propose that said valve body 110 (FIG. 3B) comprises at least one opening, presently three openings 112*a*, 112*b*, 112*c*, enabling a fluid flow through said valve body 110, preferably in a basically axial direction, i.e. perpendicular to the drawing plane of FIG. 3B. Of course, other numbers of openings are also possible for the valve body 110, and for the first valve plate 120, according to further embodiments.

Further embodiments propose that at least one of said openings 112*a*, 112*b*, 112*c* of said valve body 110 comprises a radial extension ER1, cf. FIG. 3B, that is equal to or greater than about 50% of a radial extension ER of said circular ring shape of said valve body 110. According to particularly preferred embodiments, at least one of said openings 112*a*, 112*b*, 112*c* comprises a radial extension ER1 that is equal to or greater than about 70% of said radial extension ER of said circular ring shape of said valve body 110, which enables a particularly large flow cross-section for a fluid flow F, cf. FIG. 1A, (e.g., of quenching gas) through said valve body 110, advantageously effecting a particularly small flow resistance. Thus, a reduced amount of driving energy for driving the movement of the movable parts delimiting the primary chamber 12 (FIG. 1A) and/or the compression chamber 14 of the circuit breaker 10, 10' is required.

According to further embodiments, said at least one opening 112*a*, 112*b*, 112*c* (FIG. 3B) of said valve body 110 is provided in a radially intermediate section RIS (FIG. 2A, 3A) of said valve body 110.

Further embodiments propose that said at least one opening 112*a*, 112*b*, 112*c* (FIG. 3B) of said valve body 110 extends over an angular range AR1 of at least about 60° (degrees), preferably of at least about 75°.

Further embodiments propose that an aggregated area of said one or more openings 112*a*, 112*b*, 112*c* of the valve body 110 is equal to or greater than about 50% of an overall area of said circular ring shape of said valve body, wherein a particularly small flow resistance for a fluid flow through said valve body (in both the filling state and the discharge state) is attained.

Further embodiments propose that said valve body 110 comprises one or more guide pins 116*a*, 116*b* (FIG. 2A) for guiding an axial movement of said first valve plate 120, which enables a particularly reliable and error-free operation of the valve 100. A preferred embodiment comprises three guide pins. According to some embodiments, the guide pins 116*a*, 116*b* may comprise one or more bolts. According to further embodiments, at least one of the bolts may form an integral part of said valve body 110, as depicted by FIG. 2A. According to further embodiments, at least one of the bolts may be a threaded bolt (not depicted), e.g. being releasably attachable to the valve body 110.

According to further embodiments said valve body 110 may comprise one or more guide pins for guiding an axial movement of said second valve plate 130. According to a particularly preferred embodiment, one or more guide pins 116*a*, 116*b* may be provided for guiding an axial movement of both said first valve plate 120 and said second valve plate 130, which results in a particularly simple and cost-efficient construction.

According to some embodiments, the first valve plate 120 and/or the second valve 130 plate may comprise respective guiding openings GO (FIG. 3C) for receiving the guide pins 116*a*, 116*b*.

Figure 5A:
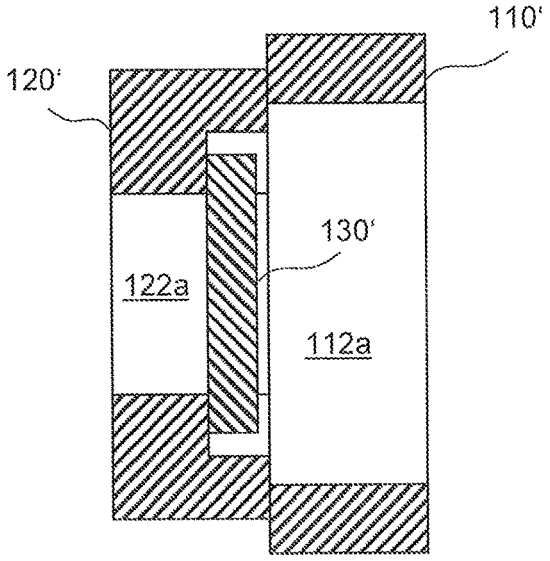
Figure 5B:
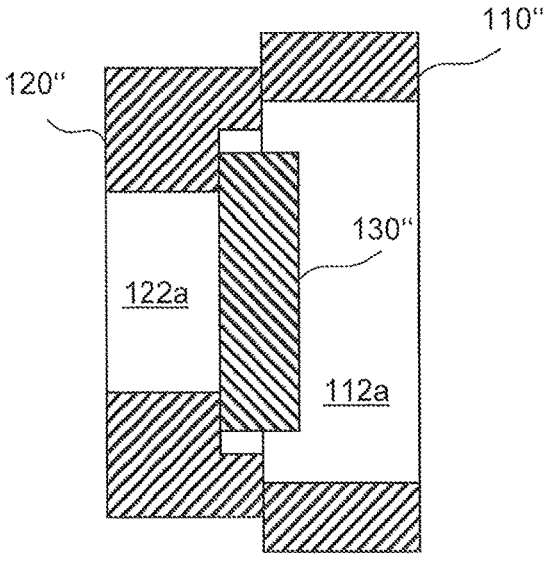

According to further embodiments, the second valve plate 130 may also be guided by radially surrounding wall sections of said valve body 110, cf. the radially inner and radially outer wall sections RI, RO of FIG. 2A, and/or by said first valve plate, particularly if said valve body and/or said first valve plate 120 comprise a "C"-shaped cross-section (also cf. the embodiments 120', 120" of FIG. 5A, 5B). In this case, according to some embodiments, no guiding pins are provided for additionally guiding said second valve plate. However, according to further embodiments, additional guide pins may be provided for said second valve plate 130, too.

According to further embodiments, said one or more guide pins 116*a*, 116*b* (FIG. 2A) are arranged in a radially intermediate section RIS of said valve body 110, which provides a particularly reliable guiding mechanism for said first valve plate 120 and/or said second valve plate 130.

Further embodiments propose that a first spring force mechanism 116' is provided to press said first valve plate 120 to said valve seat of the valve body 110. According to an embodiment, the spring force mechanism 116' may comprise one or more springs 116*a'*, 116*b'*, e.g. helical springs, arranged at said guide pins 116*a*, 116*b*. As an example, according to some embodiments, at least one of said guide pins 116*a*, 116*b* may comprise at a first axial and section arranged distal from said valve body 110 a shoulder capable of receiving a first front face of a corresponding spring 116*a'*, 116*b'*, the second front face of said spring(s) resting on the opposing second surface 120*b* of said first valve plate 120.

Further embodiments propose to provide a second spring force mechanism 126, cf. FIG. 4, to press said second valve plate 130 to said valve seat of the first valve plate 120.

According to further embodiments, however, the second valve plate 130 may move basically freely between the valve body 110 (FIG. 2A) and its valve seat at the first valve plate 120, thus forming a type of "flap valve", the movement of which may be influenced by a pressure difference between the adjacent chambers 12, 14 (FIG. 1A) and/or gravity and/or an existing fluid flow around said second valve plate 130. In these embodiments the second spring force mechanism 126 is not required.

Figure 2B:
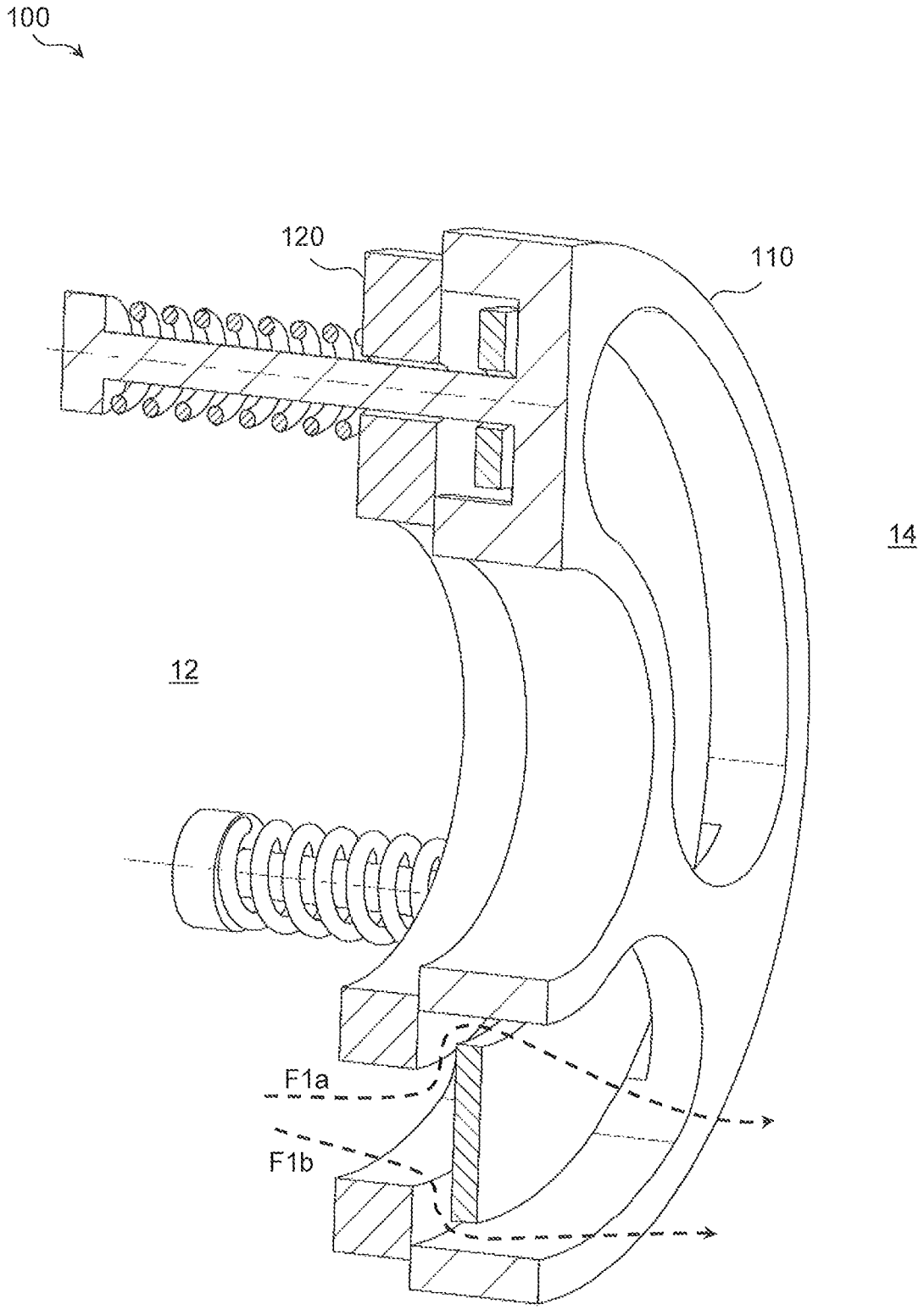

Further embodiments propose that said second valve plate 130 together with said first valve plate 120 forms a filling valve configured to enable a fluid flow from said primary chamber 12 to said compression chamber 14 if a fluid pressure in said primary chamber 12 is greater than a fluid pressure in said compression chamber 14. As both the first valve plate 120 and the second valve plate 130, which form said filling valve according to an embodiment are arranged axially movable with respect to said valve body 110, the configuration may also be denoted as "mobile filling valve". FIG. 2B depicts the valve 100 in the filling state, wherein fresh quenching gas may flow to the compression chamber 14 as indicated by arrows F1*a*, F1*b*. Advantageously, a comparatively large flow cross-section through the valve 100 and more precisely through the openings of the first valve plate 120 and the openings of the valve body 110 is provided by the principle according to the embodiments thus reducing flow resistance and drive energy required for operating the valve 100 in the filling state as well as for state transitions of the valve 100 to/from its filling state.

Figure 2C:
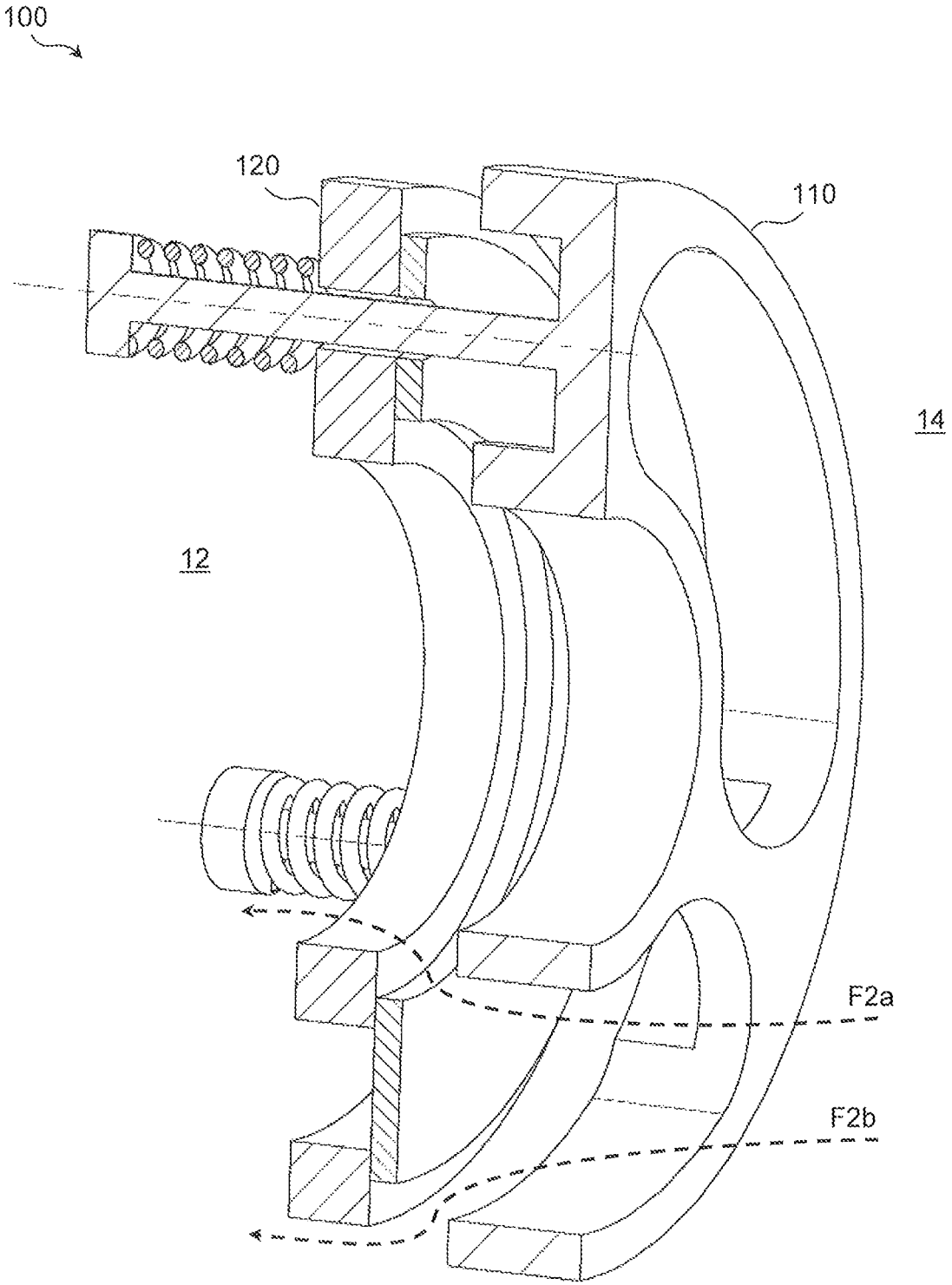

Further embodiments propose that the second valve plate 130 together with said first valve plate 120 and the valve body 110 form a discharge valve configured to enable a fluid flow from said compression chamber 14 to said primary chamber 12 if a fluid pressure in said compression chamber 14 is greater than a fluid pressure in said primary chamber 12. FIG. 2C depicts the valve 100 in the discharge state wherein quenching gas may flow from the compression chamber 14 to the primary chamber 12 as indicated by arrows F2*a*, F2*b*. Advantageously, and similar to the filling state of FIG. 2B, a comparatively large flow cross-section through the valve 100 and more precisely through the openings of the valve body 110 and radially around the components 120, 130 is provided by the principle according to the embodiments thus reducing flow resistance for the operation of the valve 100 in the discharge state.

Similar to FIG. 4, the FIGS. 5A, 5B schematically depict a detail of a cross-sectional side view of a valve according to further embodiments. In the embodiments of FIG. 5A, 5B, the first valve plate 120', 120" comprises a basically circular ring shape, however, with "C"-shaped cross-section, in contrast to the basically rectangular cross-section of the embodiment explained above with reference to FIG. 2A. The "C"-shaped cross-section enables to at least partially (FIG. 5B) or fully (FIG. 5A) position the second valve plate 130 within the interior of said "C"-shape of the valve plate 120', 120", whereby an overall length of the valve along the axial direction may be further reduced. Also, the first and second valve seats are still formed by the three components 110', 120', 130' (FIG. 5B: 110", 120", 130") and not by components external to said valve, as required with the conventional systems.

A further advantage of the principle according to the embodiments is based on the fact that the specific design of the valve plates 120, 130 may be changed without substantially influencing the flow cross-section for the discharge operation, as this is substantially defined by the openings within the valve body 110, cf. FIG. 2C.

Yet another advantage of the principle according to the embodiments is the axial arrangement of the components 110, 120, 130 implementing the filling valve functionality and the discharge valve functionality. This enables to either reduce the radial dimensions of the valve 100 (and thus e.g. to reduce an outer diameter of an interrupter unit comprising the contact elements 16' as well as all other components of the circuit breaker surrounding the interrupter unit) while maintaining a sufficient flow cross-section for the fluid flow F (FIG. 1A) through the valve 100 or to reduce the flow resistance as compared to conventional valves which e.g. comprise a radial or angular separation of the filling valve function and the discharge valve function.

Advantageously, a reduced flow resistance also contributes to an improved breaking (disconnecting) performance as less energy is required for driving the movement of movable parts required for a switching operation of the circuit breaker. Further advantageously, by reducing the flow resistance of the valve 100, fluidic (especially pneumatic) energy losses within the circuit breaker may be reduced, which enables to provide smaller and less costly driving and/or switching (interrupting) mechanisms.

The comparatively low complexity of the valve 100 according to the embodiments further enables to reduce costs of the circuit breaker 10, 10'.

The invention claimed is:

1. An electric high-voltage circuit breaker comprising:
a primary chamber; and
a compression chamber,
wherein the circuit breaker further comprises:
a valve configured to control a fluid flow between the primary chamber and the compression chamber, wherein the valve comprises:
a valve body,
a first valve plate that is arranged axially movable with respect to the valve body, and
a second valve plate that is arranged between and movable with respect to the valve body and the first valve plate,
wherein the first valve plate comprises:
at least one opening enabling the fluid flow through the first valve plate, wherein a first surface of the valve body forms a valve seat for the first valve plate, and wherein a first surface of the first valve plate forms a valve seat for the second valve plate; and
wherein the first valve plate and the second valve plate each comprise a circular ring shape, wherein an outer diameter of the second valve plate is smaller than an outer diameter of the first valve plate.

2. The circuit breaker according to claim 1, wherein the valve seat for the second valve plate is formed such that the second valve plate may be pressed to the valve seat of the first valve plate in a manner so as to seal the at least one opening of the first valve plate.

3. The circuit breaker according to claim 1, wherein the valve body comprises a circular ring shape or a rectangular cross-section.

4. The circuit breaker according to claim 3, wherein the valve body comprises one or more openings, wherein at least one of the openings comprises a radial extension that is equal to or greater than about 50 percent of a radial extension of the circular ring shape of the valve body.

5. The circuit breaker according to claim 4, wherein an aggregated area of the one or more openings is equal to or greater than about 50 percent of an overall area of the circular ring shape of the valve body.

6. The circuit breaker according to claim 1, wherein the valve body comprises one or more guide pins for guiding an axial movement of the first valve plate and/or the second valve plate.

7. The circuit breaker according to claim 6, wherein the one or more guide pins are arranged in a radially intermediate section (RIS) of the valve body.

8. The circuit breaker according to claim 1, wherein a first spring force mechanism is provided to press the first valve plate to the valve seat of the valve body.

9. The circuit breaker according to claim 1, wherein a second spring force mechanism is provided to press the second valve plate to the valve seat of the first valve plate.

10. The circuit breaker according to claim 1, wherein the second valve plate together with the first valve plate forms a filling valve configured to enable the fluid flow from the primary chamber to the compression chamber if a fluid pressure in the primary chamber is greater than a fluid pressure in the compression chamber.

11. The circuit breaker according to claim 1, wherein the second valve plate together with the first valve plate and the valve body forms a discharge valve configured to enable the fluid flow from the compression chamber to the primary chamber if a fluid pressure in the compression chamber is greater than a fluid pressure in the primary chamber.

12. The circuit breaker according to claim 1, wherein the at least one opening of the first valve plate is provided in a radially intermediate section of the first valve plate.

13. The circuit breaker according to claim 1, wherein the circular ring shape of the each of the first valve plate and the second valve plate further comprises a rectangular cross-section.

* * * * *